US011478028B2

(12) United States Patent
Schwadron

(10) Patent No.: US 11,478,028 B2
(45) Date of Patent: Oct. 25, 2022

(54) DISPOSABLE CUT-RESISTANT GLOVE

(71) Applicant: Wells Lamont Industry Group LLC, Skokie, IL (US)

(72) Inventor: Stuart Schwadron, Oak Park, IL (US)

(73) Assignee: Wells Lamont Industry Group LLC, Skokie, IL (US)

( * ) Notice: Subject to any disclaimer, the term of this patent is extended or adjusted under 35 U.S.C. 154(b) by 26 days.

(21) Appl. No.: 16/840,593

(22) Filed: Apr. 6, 2020

(65) Prior Publication Data

US 2020/0315270 A1 Oct. 8, 2020

Related U.S. Application Data

(60) Provisional application No. 62/830,161, filed on Apr. 5, 2019.

(51) Int. Cl.
*A41D 19/00* (2006.01)

(52) U.S. Cl.
CPC ..... *A41D 19/0096* (2013.01)

(58) Field of Classification Search
CPC ..... A41D 19/0096; A41D 19/01505; A41D 19/01511; A41D 19/0055; F41H 5/00; F41H 1/02
USPC ..... 2/2.5, 16, 167; 428/911
See application file for complete search history.

(56) References Cited

U.S. PATENT DOCUMENTS 3,883,898 A 5/1975 Byrnes
4,004,295 A 1/1977 Byrnes
4,232,087 A 11/1980 Trask
4,299,884 A 11/1981 Payen
4,321,854 A 3/1982 Foote
4,384,449 A 5/1983 Byrnes
4,470,251 A 9/1984 Bettcher
4,777,789 A 10/1988 Kolmes
4,838,017 A 6/1989 Kolmes
4,912,781 A 4/1990 Robins
5,248,548 A 9/1993 Toon
5,617,713 A 4/1997 Mawick
5,632,138 A 5/1997 Liedgens
5,644,907 A 7/1997 Kolmes
5,721,179 A 2/1998 Shi
5,745,919 A 5/1998 Kraatz
5,806,295 A 9/1998 Robins
5,853,885 A 12/1998 Prickett
6,001,474 A 12/1999 Prickett
6,033,779 A 3/2000 Andrews
6,155,084 A 12/2000 Andrews
(Continued)

FOREIGN PATENT DOCUMENTS

EP 1160363 A1 12/2001

*Primary Examiner* — Nathan E Durham
*Assistant Examiner* — Abby M Spatz
(74) *Attorney, Agent, or Firm* — Levenfeld Pearlstein, LLC

(57) ABSTRACT

A glove includes a material layer made from a plastic material shaped to include a palm, a back, fingers and a thumb and to define an interior space and an opening providing access to the interior space. The glove further includes a plurality of pods formed in the material layer, the pods having a predetermined first thickness, and a plurality of connecting tabs connected between the pods, the connecting tabs having a second thickness less than the first thickness. The pods are configured to provide cut-resistance properties. The glove may be disposable. The glove may be ambidextrous.

8 Claims, 6 Drawing Sheets

(56) References Cited

U.S. PATENT DOCUMENTS

| | | | | |
|---|---|---|---|---|
| 6,161,370 | A | 12/2000 | Bertram | |
| 6,216,431 | B1 | 4/2001 | Andrews | |
| 6,260,344 | B1 | 7/2001 | Chakravarti | |
| 6,266,951 | B1 | 7/2001 | Chakravarti | |
| RE37,430 | E | 10/2001 | Toon | |
| 6,363,703 | B1 | 4/2002 | Kolmes | |
| 6,467,251 | B1 | 10/2002 | Kolmes | |
| 6,534,175 | B1 | 3/2003 | Zhu | |
| 6,630,087 | B1 | 10/2003 | Hancock | |
| 6,779,330 | B1 | 8/2004 | Andrews | |
| 6,796,115 | B1 | 9/2004 | Patrick | |
| 6,969,548 | B1 * | 11/2005 | Goldfine | B29C 44/1214 428/159 |
| 7,121,077 | B2 | 10/2006 | Andrews | |
| 7,185,481 | B2 | 3/2007 | Hughes | |
| 7,762,053 | B2 | 7/2010 | Takada | |
| 8,074,436 | B2 | 12/2011 | Hardee | |
| 8,146,171 | B2 | 4/2012 | Chung | |
| 8,191,429 | B2 | 6/2012 | Hook | |
| 8,621,890 | B2 | 1/2014 | Veillet | |
| 8,887,317 | B2 | 11/2014 | Hirsch | |
| 9,877,529 | B2 | 1/2018 | Andrews | |
| 9,994,979 | B2 | 6/2018 | Kolmes | |
| 10,081,887 | B2 | 9/2018 | Manipatruni | |
| 10,119,205 | B2 | 11/2018 | Klein | |
| 10,130,128 | B2 | 11/2018 | Andrews | |
| 10,168,774 | B2 | 1/2019 | Fisher | |
| 10,266,009 | B2 | 4/2019 | Lee | |
| 10,358,748 | B2 | 7/2019 | Sugimoto | |
| 2003/0182922 | A1 | 10/2003 | Peters | |
| 2004/0219852 | A1 | 11/2004 | Eichhorn | |
| 2005/0155336 | A1 | 7/2005 | Robins | |
| 2007/0062173 | A1 | 3/2007 | Hummel | |
| 2008/0155730 | A1 | 7/2008 | Goddard | |
| 2009/0183296 | A1 | 7/2009 | Hardee | |
| 2009/0276933 | A1 * | 11/2009 | Dodd | A43B 3/0036 2/16 |
| 2011/0047672 | A1 | 3/2011 | Hatfield | |
| 2013/0065470 | A1 | 3/2013 | Rock | |
| 2013/0076699 | A1 | 3/2013 | Spencer | |
| 2014/0090349 | A1 | 4/2014 | Fisher | |
| 2014/0259285 | A1 | 9/2014 | Andrews | |
| 2014/0283559 | A1 | 9/2014 | Andrews | |
| 2016/0060809 | A1 | 3/2016 | Hines | |
| 2019/0059476 | A1 | 2/2019 | Taylor | |

* cited by examiner

DISPOSABLE CUT-RESISTANT GLOVE

CROSS-REFERENCE TO RELATED APPLICATION DATA

This application claims the benefit of and priority to Provisional U.S. Patent Application Ser. No. 62/830,161, filed Apr. 5, 2019, titled DISPOSABLE CUT-RESISTANT GLOVE, the disclosure of which is incorporated herein in its entirety.

BACKGROUND

The present disclosure relates to cut-resistant gloves, and in particular, disposable cut-resistant gloves.

Protective gloves commonly have cut-resistance and/or liquid-resistance properties. A known protective glove is a metal chainmail glove formed by a plurality of interlocked chain links. Such a glove is known to provide suitable cut-resistance, for example, in the foodservice industry. Such gloves are commonly used in facilities such as restaurant or commercial kitchens, meatpacking facilities, or other locations where food products are frequently cut with a knife.

However, chainmail gloves are relatively expensive to manufacture, and in turn, relatively expensive for the consumer (e.g., the facility operator) to purchase. Thus, the consumer may purchase several gloves to be shared on a repeat basis between multiple users in a particular facility. This can result in such gloves being frequently misplaced or lost requiring the purchase of additional gloves. In addition, sharing of the gloves gives rise to sanitary concerns, for example, by way of germs being transferred between users. Moreover, such chainmail gloves, by their nature, include a number of openings through which a user's hand may become exposed to external liquids, such as liquids from raw foods, grease from meat processing or associated products from a manufacturing environment for example.

Accordingly, it is desirable to provide a cut-resistant glove that offers suitable cut-resistance and optionally liquid-resistance properties, and that can be manufactured relatively easily and inexpensively when compared to known metal chainmail gloves, so as to be disposable.

SUMMARY

A glove includes a material layer made from a plastic material shaped to include a palm, a back, fingers and a thumb and to define an interior space and an opening providing access to the interior space, for example to receive a hand in the interior space. A plurality of pods are formed in the material layer. The pods have a predetermined first thickness. A plurality of connecting tabs are connected between the pods. The connecting tabs have a second thickness less than the first thickness.

In one embodiment, the plastic material may be an injection moldable plastic material. However, other suitable materials are envisioned as well, including plastic materials suitable for use in 3D printing applications, and/or plastic, or plastic-type materials associated with sculpting plastics and resins. The connecting tabs may be recessed relative to the pods. At least one connecting tab of the plurality of connecting tabs may be connected to four pods. In one aspect, each connecting tab may be connected to four pods.

The pods may be hexagonal in shape. At least one connecting tab may include a first portion extending between and connecting vertices of a first two adjacent pods of the plurality of pods and a second portion extending between and connecting flat segments of a second two adjacent pods of the plurality of pods. The second two adjacent pods may be positioned at least partly between the first two adjacent pods along at least one direction.

The plurality of pods may be arranged in a honeycomb pattern. In one aspect, a plurality of openings are provided between the pods and the connecting tabs and extend through a thickness of the material layer such that the interior space may be in fluid communication with external atmosphere through the openings.

The pods and the connecting tabs may be continuous with one another and formed as a one-piece construction. The material layer may be injection molded.

The material layer may further include a base underlying the pods and the connecting tabs such that the material layer is substantially fluid-resistant. The base, the pods and the connecting tabs may be continuous with one another and formed as a one-piece construction. The material layer may be injection molded.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 2:
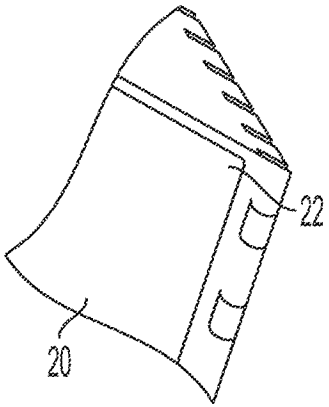
FIG. 2 is an enlarged view showing an interior portion of a glove according to an embodiment.

While the present disclosure is susceptible of embodiments in various forms, there is shown in the drawings and will hereinafter be described a presently preferred embodiment with the understanding that the present disclosure is to be considered an exemplification and is not intended to limit the disclosure to the specific embodiment illustrated.

Figure 1:
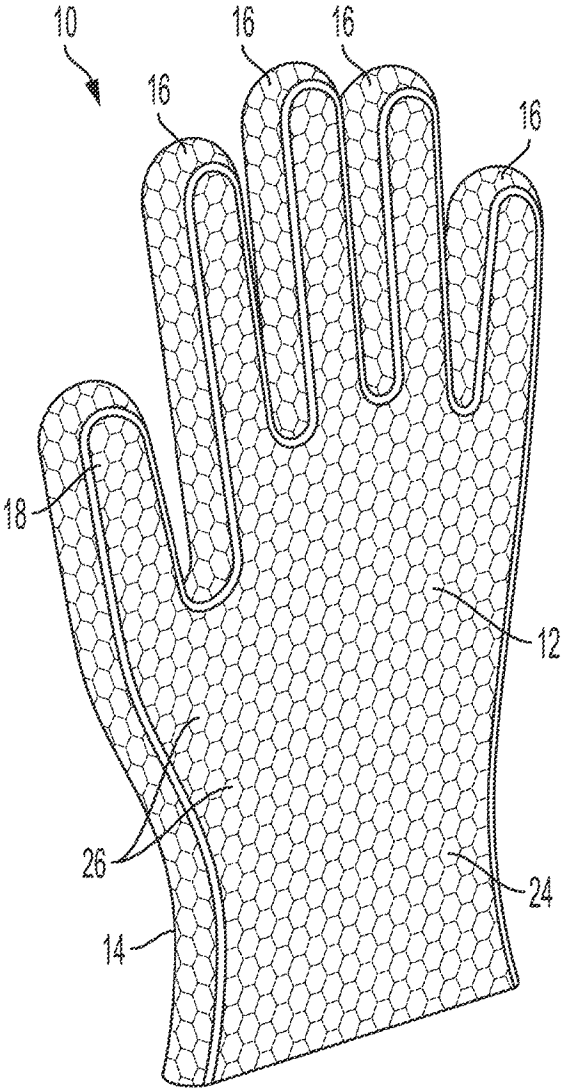
FIG. 1 is a perspective view of a glove according to an embodiment.

FIG. 1 is a perspective view of a glove 10 according to an embodiment and FIG. 2 is an enlarged view showing an interior portion of the glove 10. The glove 10 includes a palm 12, a back 14, fingers 16 and a thumb 18 and defines an interior space 20 (FIG. 2) configured to receive a hand (not shown) through an opening 22 (FIG. 2). The opening 22 can be formed at a lower end of the glove 10, opposite to the fingers 16 and the thumb 18. In one embodiment, the glove 10 is formed by a material layer 24 which includes a plurality of interconnected pods 26.

Figure 3:
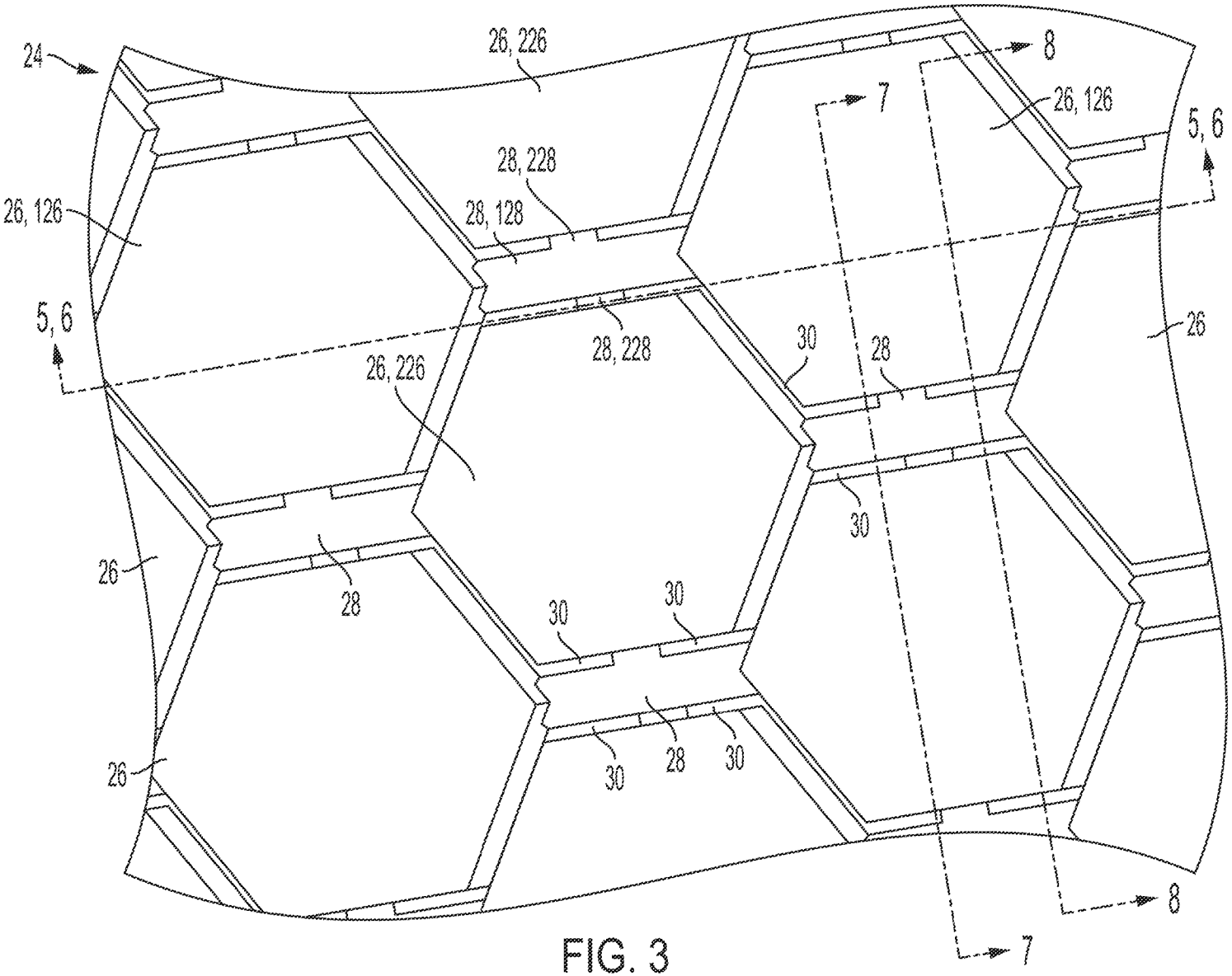
FIG. 3 is an enlarged view showing an exterior portion of the glove of FIG. 1.

FIG. 3 is an enlarged view of the material layer 24 at an outer surface of the glove 10 of FIG. 1. With reference to FIGS. 1-3, in one embodiment, the pods 26 are connected to one another by connecting tabs 28. Preferably, the material layer 24 is made of a flexible, plastic material. In addition, the material layer 24 may be formed as a continuous, one-piece construction, such that the pods 26 and the connecting tabs 28 are continuous with one another. Thus, additional fasteners, such as known mechanical fasteners, adhesives and the like, are not required to secure the pods 26 to the connecting tabs 28. In one embodiment, the material layer 24 may be formed by injection molding. Accordingly, the plastic material of the material layer 24 is made from an injection moldable plastic material.

In one embodiment, the glove 10 is formed in its entirety by the material layer 24. That is, the material layer 24 may be produced in an injection molding process, in a shape which includes the palm 12, the back 14, the fingers 16 and the thumb 18 described above, and further, to define the interior space 20 and the opening 22 through which a hand may be received in the interior space 20. In one embodiment, inner and outer surfaces of the material layer 24 form inner and outer surfaces, respectively, of the glove 10.

In one embodiment, the pods 26 may be substantially polygonal in shape, such as hexagonal. Other shapes, including non-polygonal shapes are envisioned, however. The connecting tabs 28 extend between and connect the pods 26 to one another. For example, in one embodiment, at least one connecting tab 28 may be connected to four different pods 26. In one embodiment, each connecting tab 28 is connected to four different pods 26. Conversely, in one embodiment, at least one pod 26 may be connected to four different connecting tabs 28. In one embodiment, each pod 26 is connected to four different connecting tabs 28.

Referring still to FIG. 3, the connecting tabs 28 may each include a first portion 128 extending between and connecting vertices of a first two adjacent pods 126, 126. The connecting tabs 28 may each further include a second portion 228 extending between and connecting flat segments of a second two adjacent pods 226, 226 which may be positioned at least partly between the first two adjacent pods 126, 126 along at least one direction.

In one embodiment, a plurality of spaces 30 may be formed between portions of the pods 26 and the connecting tabs 28. The spaces 30 may extend from the interior space 20 to the external atmosphere, i.e., through the thickness of the glove 10. Thus, the spaces 30 may allow for fluid communication between the interior space 20 and the external atmosphere. In addition, the connecting tabs 28 as well as the spaces 30 may allow for flexibility and relative movement of the pods 26.

Figure 4:
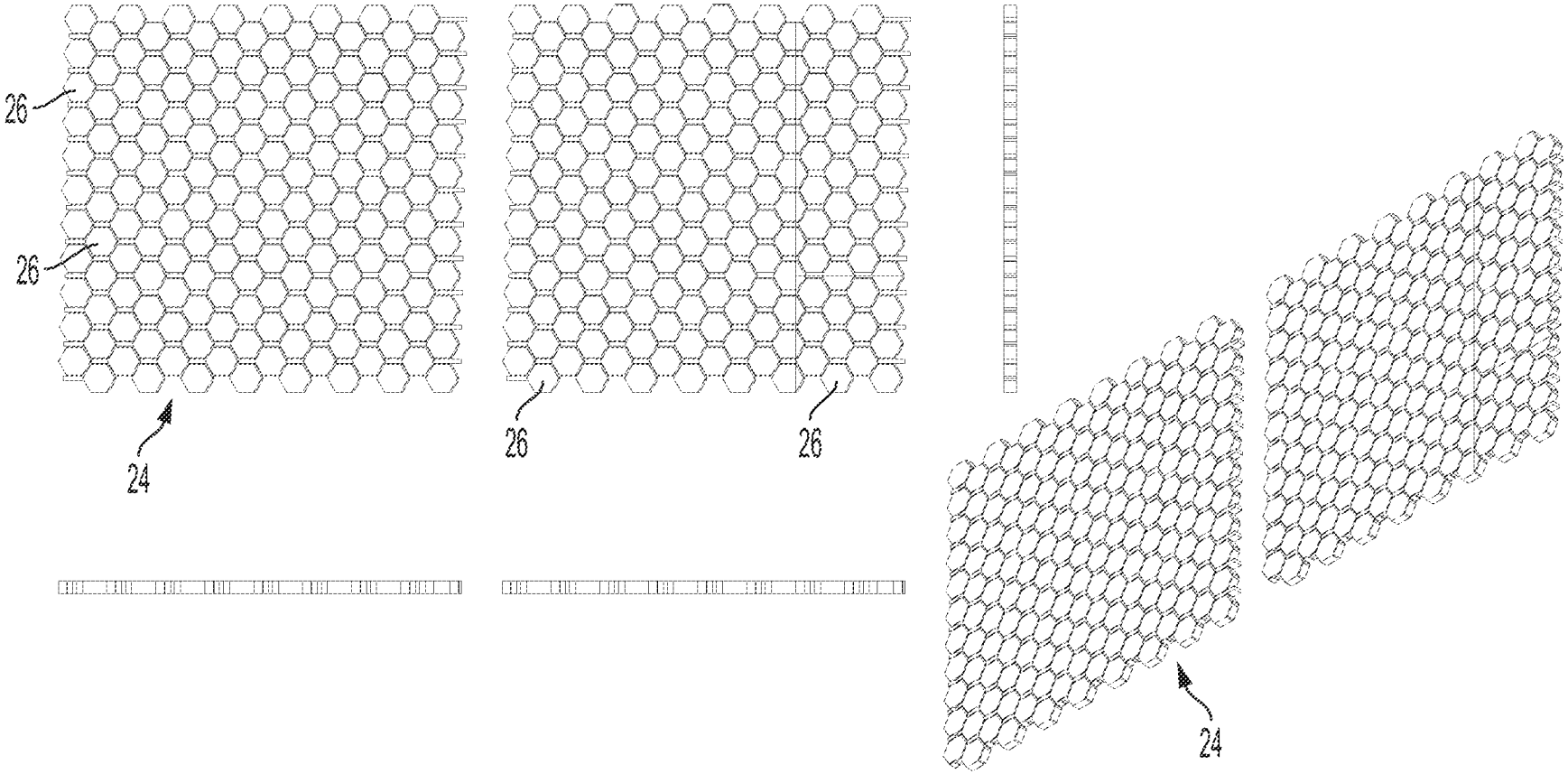
FIG. 4 shows various views of exterior portions of the glove of FIG. 1.

FIG. 4 shows plan views and perspective views of portions of the material layer 24 including the plurality of pods 26 described in the embodiments above. In one embodiment, the pods 26 may be arranged substantially in a honeycomb pattern, with the connecting tabs 28 (FIG. 3) interposed therebetween as described above. In a non-limiting embodiment, each pod 26 may have a width of approximately 0.5 inches and may be spaced from at least one adjacent pod 26 by approximately 0.02 inches. It is understood, however, that these examples are provided simply for illustrative purposes, that the present disclosure is not limited to these examples, and that other dimensions and ratios of such dimensions are envisioned depending on a desired application of the glove in order to provide, for example, suitable or desired characteristics such as cut-resistance and/or flexibility. For example, in another non-limiting embodiment, each pod 26 may have a width of approximately 0.25 inches and may be spaced from adjacent pods 26 by approximately 0.127 inches.

Figure 5:
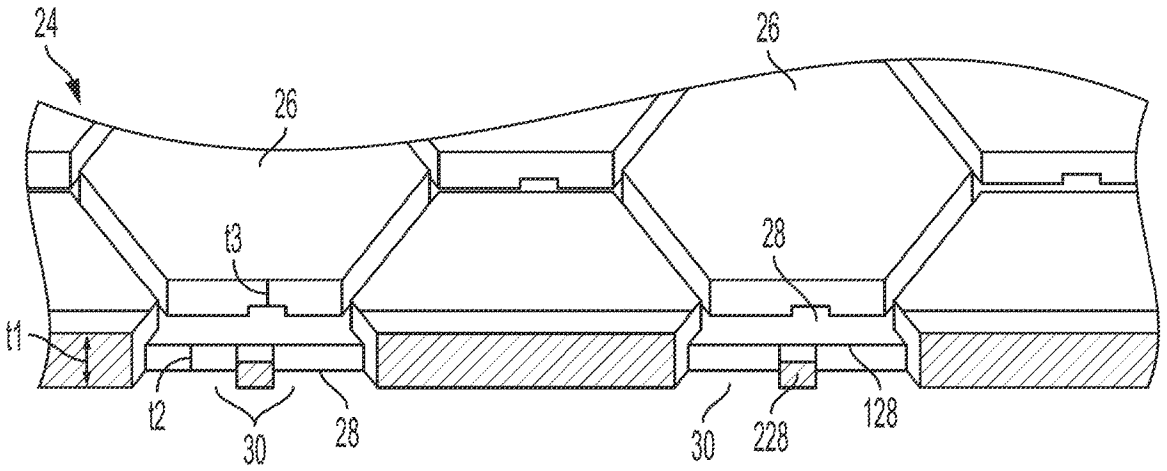
FIG. 5 is a perspective cross-sectional view of the glove generally representative of a view taken at A-A in FIG. 3, according to an embodiment.
Figure 6:
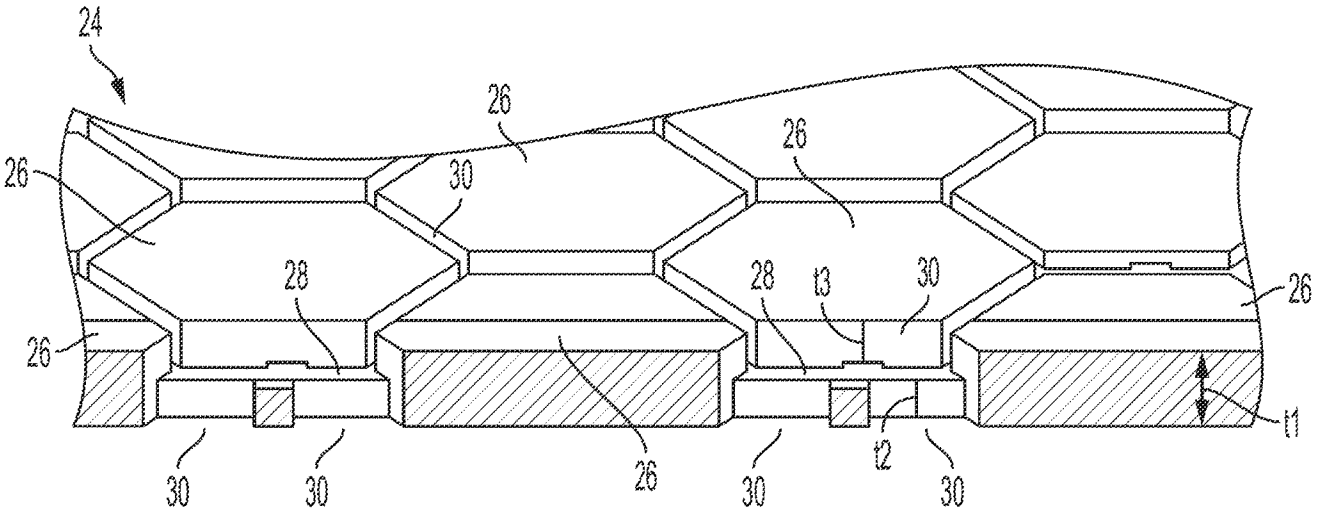
FIG. 6 is another perspective cross-sectional view of the glove generally representative of a view taken at A-A in FIG. 3, according to an embodiment.

FIG. 5 is a perspective cross-sectional view of the material layer 24, generally representative of a view taken at section A-A in FIG. 3, according to an embodiment. FIG. 6 is another perspective cross-sectional view of the material layer 24 generally representative of a view taken at A-A in FIG. 3, according to an embodiment. Referring to FIGS. 5 and 6, the pods 26 are formed having a first thickness t1 and the connecting tabs 28 are formed having a second thickness t2, less than the first thickness t1. Thus, in one embodiment, the connecting tabs 28 may be recessed from an outer surface of the pods 26 by a third thickness t3, which is the difference between the first thickness t1 and the second thickness t2.

In a non-limiting embodiment, the second thickness t2 may be approximately one half, or less than half of the first thickness t1. However, the present disclosure is not limited to these thicknesses. Rather, the respective thicknesses t1, t2 of the pods 26 and the connecting tabs 28 may be varied during manufacture, e.g., during injection molding, based on a variety of factors, including type of material used in the material layer 24, desired flexibility, desired cut-resistance, weight, size, and the like.

For example, reducing the first thickness t1 of the pods 26 may allow for great flexibility, reduced weight and/or reduced cut-resistance, as suitable. Conversely, increasing the first thickness t1 of the pods 26 generally increases cut-resistance. It will be recognized, however, that pods 26 made of a relatively strong material may have a smaller thickness t1 while having the same or increased cut-resistance than pods 26 made of a relatively soft material in another material layer 24. The choice of material can be made based on a number of factors, including cost, ease of manufacture, durability, intended application or environment in which the glove 10 is to be used, weight, size, and the like.

In one embodiment, the connecting tabs 28 may be recessed relative to the pods 26 such that the connecting tabs 28 may be more easily flexed in a direction which moves outer (top) surfaces of the pods 26 toward one another to reduce a distance between adjacent pods, than in an opposite direction in which outer surfaces of the pods 26 are moved away from one another to increase a distance between adjacent pods 26. In this manner, an inadvertent increase in exposure to the reduced thickness portions of the glove 10, i.e., the connecting tabs 28, may be reduced.

In addition, reducing the second thickness t2 of the connecting tabs 28 may increase flexibility of the material layer 24 and the glove 10, while increasing the second thickness t2 may stiffen the material layer 24 and the glove 10. In some embodiments, the connecting tabs 28 may act as living hinges, such they can flex to allow movement of the pods 26 relative to one another. In one embodiment, the connecting tabs 28 are configured to flex along at least two different directions.

Figure 7:
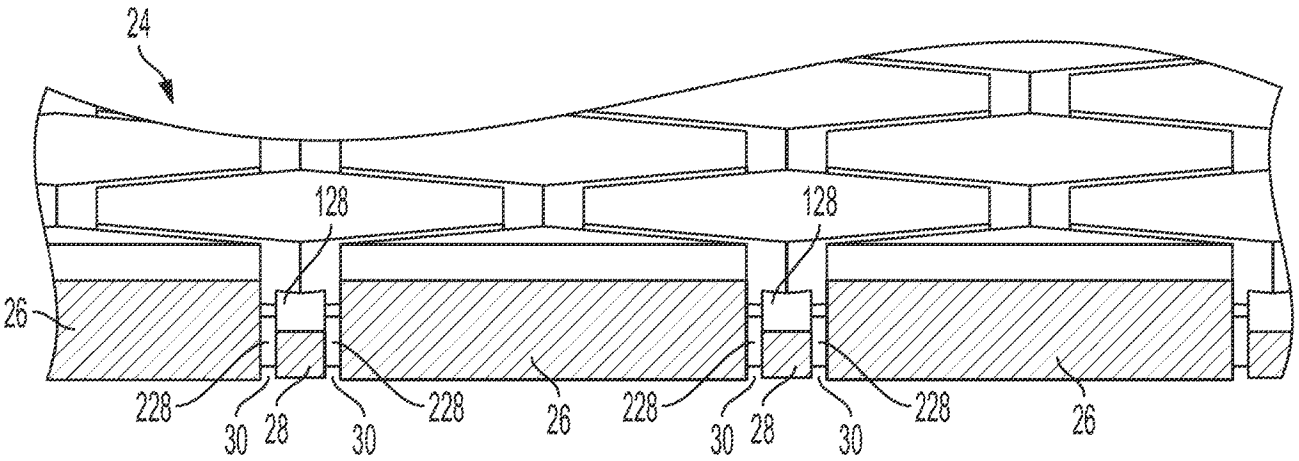
FIG. 7 is a perspective cross-sectional view of the glove generally representative of a view taken at B-B in FIG. 3, according to an embodiment.
Figure 8:
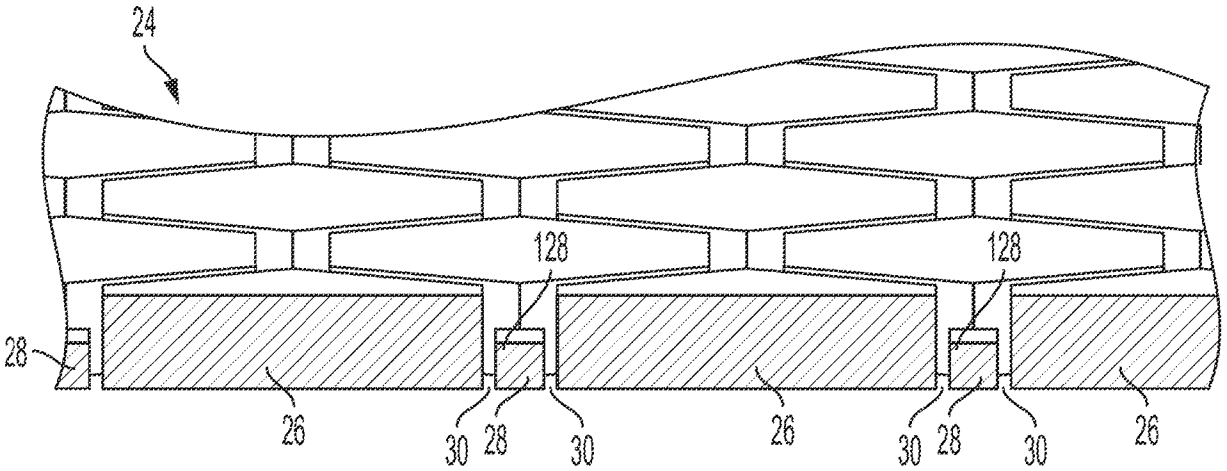
FIG. 8 is a perspective cross-sectional view of the glove generally representative of a view taken at C-C in FIG. 3, according to an embodiment

FIG. 7 is a perspective cross-sectional view of the material layer 24 generally representative of a view taken at B-B in FIG. 3, according to an embodiment. FIG. 8 is a perspective cross-sectional view of the material layer 24 generally representative of a view taken at C-C in FIG. 3, according to an embodiment. Referring to FIGS. 7 and 8, the first portion 128 of a connecting tab 28 may be connected to a vertex on a pod 26. Spaces 30 may be disposed on opposite sides of the first portions 128. As shown in FIG. 7, the second portions 228 of a connecting tab 28 may extend from opposite sides of the first portion 128 and connect to flat segments of adjacent pods 26.

Figure 9:
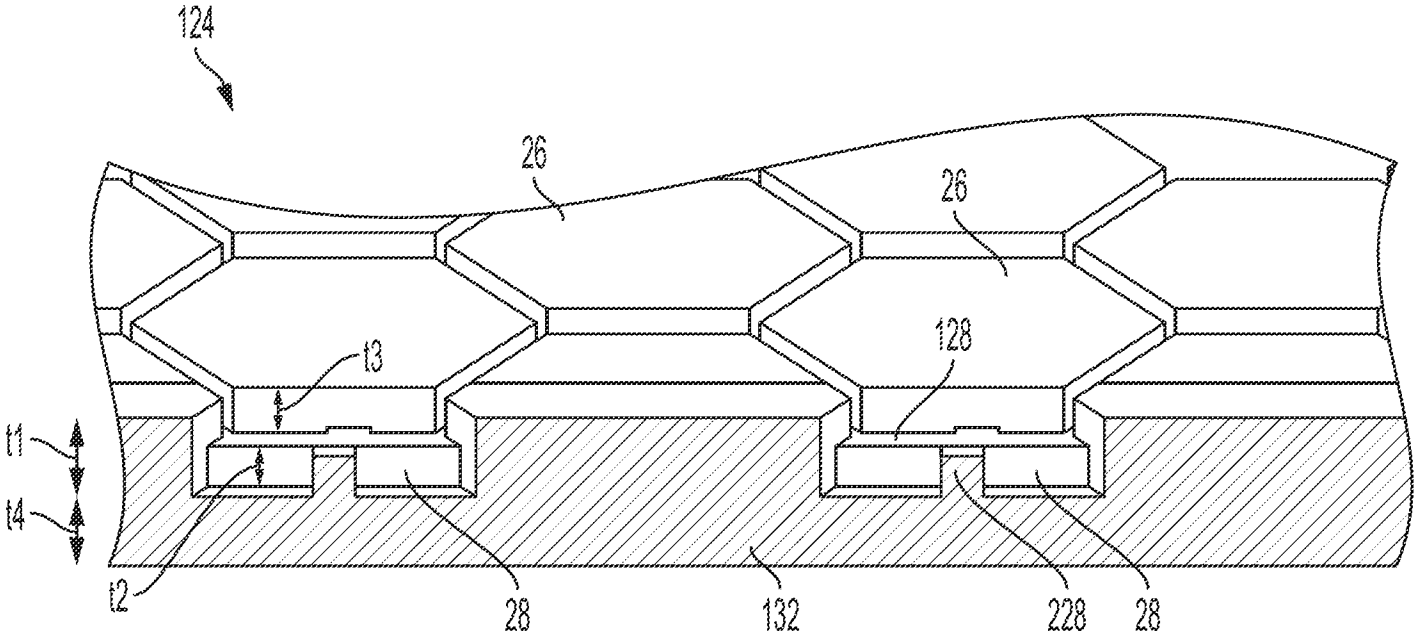
FIG. 9 is a perspective cross-sectional view of a glove according to another embodiment.

FIG. 9 is a perspective cross-sectional view of a material layer 124 of a glove according to another embodiment. The material layer 124 includes features similar to those of the material layer 24 described in the embodiments above. Accordingly, the following description addresses differences between the material layer 124 and the material layer 24 of the embodiments above, while further description of like features may be omitted.

In one embodiment, the material layer 124 may further include a base 132. The base 132 may be formed as a continuous, one-piece construction with the pods 26 and the connecting tabs 28. For example, the base 132 may be formed with the pods 26 and the connecting tabs 28 during manufacture of the material layer 124 in an injection molding process described above.

In one embodiment, the base 132 underlies the pods 26 and the connecting tabs 28. Accordingly, an inner surface of the base 132 may form an inner surface of the glove 10. In addition, the base 132 may extend across, and eliminate the spaces 30 formed between the pods 26 and the connecting tabs 28 of the material layer 24 described in the embodiments above. In this manner, the glove 10 may be made substantially fluid-resistant, such that communication of air and/or liquids between the interior space 20 and the external atmosphere through the material layer 124 is prevented or substantially restricted.

A thickness t4 of the base 132 may be controlled during manufacture to provide, for example, a desired level of flexibility, weight, size and the like, as well as desired cut-resistance properties, in the glove 10.

In one embodiment, the pods 26 and the connecting tabs 28 may be disposed substantially across an entirety of an outer surface of the glove 10, so as to extend across the palm 12, the back 14, the fingers 16 and the thumb 18. In such an embodiment, the glove 10 may be an ambidextrous glove. In another embodiment, the pods 26 and the connecting tabs 28 may be disposed over less than an entirety of the glove 10. Nevertheless, depending on the positioning of the pods 26 and the connecting tabs 28, the glove 10 may still be used as an ambidextrous glove so long as a suitable level of cut-resistance and other desired properties may be provided to both hands for particular applications.

In one embodiment, the pods 26 and the connecting tabs 28 may be disposed both on the palm 12 and the back 14 of the glove 10. As described above, such a configuration allows for ambidextrous use of the glove 10. In addition, on the palm 12 side, the pods 26 and the connecting tabs 28 may provide improved gripping capabilities.

In some embodiments, the glove 10 may be formed with the pods 26 having different thicknesses and/or shapes at different positions on the glove 10. For example, the pods 26 may be formed having an increased thickness at locations on the glove 10 where increased cut-resistance may be desirable. Similarly, the connecting tabs 28 may be formed having different thicknesses and/or shapes at different positions on the glove 10. For example, the thickness of the connecting tabs 28 may be reduced at locations on the glove 10 where increased flexibility may be desirable.

The glove 10 according to the embodiments described herein may be manufactured at relatively low costs compared to conventional chainmail gloves. For example, the gloves 10 of the present embodiments may be formed from a plastic material, preferably an injection moldable plastic material, which is relatively flexible, durable and inexpensive. Such a glove 10 can provide suitable levels of cut-resistance by way of the pods 26 and flexibility by way of the connecting tabs 28. A thickness of the pods 26 may be varied during manufacture to provide the desired cut-resistance properties. Similarly, a thickness of the connecting tabs 28 may be varied during manufacture to provide different levels of flexibility in the glove 10.

Further, the glove 10 may optionally provide fluid or liquid-resistance, by way of the base 132. The base 132, the pods 26 and the connecting tabs 28 may be formed as a continuous, one-piece construction in an injection molding process. Moreover, the glove 10 may be an ambidextrous glove.

As an alternative, in one embodiment, the glove 10 may be laminated. For example, in one embodiment, the base 132 may be formed separately from the pods 26 and the connecting tabs 28, and one or more of the pods 26 and/or one or more of the connecting tabs 28 may adhered to the base 132 with a suitable adhesive, such as a hot-melt adhesive.

In another embodiment, the glove 10 may further include a cover (not shown) and the pods 26 and connecting tabs 28 may be disposed between the base 132 and the cover. The cover may be formed in the same manner as the base 132 according to any of the embodiments described herein. One or more pods 26 and/or one or more connecting tabs 28 may be laminated to the cover, the base 132, or both. In another embodiment, the pods 26 and the connecting tabs 28 may be enveloped between the cover and base 132 without being laminated or otherwise adhered to the cover or base 132. Thus, in such an embodiment, the pods 26 and the connecting tabs 28 may float between the cover and base 132.

In still another embodiment, the glove 10 may include the cover, but the base 132 may be omitted, such that the pods 26 and the connecting tabs 28 form an inner surface of the glove 10 and the cover forms an outer surface of the glove 10.

Because of the relatively low cost of manufacture, the glove 10 may be disposable after a single, or limited number of uses, while still providing cost benefits relative to conventional chainmail gloves. In addition, because the glove 10 may be disposable, sharing between multiple users is not necessary.

In the present disclosure, the words "a" or "an" are to be taken to include both the singular and the plural. Conversely, any reference to plural items shall, where appropriate, include the singular. All patents and published applications referred to herein are incorporated by reference in their entirety, whether or not specifically done so within the text of this disclosure. Further, features from one of the embodiments above may be combined with, implemented in, or replace features from any of the other embodiments above.

It will also be appreciated by those skilled in the art that any relative directional terms such as sides, upper, lower, top, bottom, rearward, forward and the like are for explanatory purposes only and are not intended to limit the scope of the disclosure.

From the foregoing it will be observed that numerous modifications and variations can be made without departing from the true spirit and scope of the novel concepts of the present disclosure. It is to be understood that no limitation with respect to the specific embodiments illustrated is intended or should be inferred.

The invention claimed is:

1. A glove comprising:

a material layer made from a plastic material shaped to include a palm, a back, fingers and a thumb and to define an interior space and an opening providing access to the interior space;

a plurality of hexagonal shaped pods formed in the material layer, the pods having a predetermined first thickness; and a plurality of discrete connecting tabs connected between the pods, each of at least some of the connecting tabs directly connected to four pods, the connecting tabs having a second thickness less than the first thickness, each connecting tab connected to a portion of a side of a pod of the plurality hexagonal shaped pods, wherein a plurality of openings are provided between the pods and the connecting tabs and extend through a thickness of the material layer such that the interior space is in fluid communication with external atmosphere through the plurality of openings.

2. The glove of claim 1, wherein the plastic material is an injection moldable plastic material.

3. The glove of claim 1, wherein the connecting tabs are recessed relative to the pods.

4. The glove of claim 1, wherein at least one connecting tab includes a first portion extending between and connecting vertices of a first two adjacent pods of the plurality of pods and a second portion extending between and connecting flat segments of a second two adjacent pods of the plurality of pods.

5. The glove of claim 4, wherein the second two adjacent pods are positioned at least partly between the first two adjacent pods in at least one direction.

6. The glove of claim 1, wherein the plurality of pods are arranged in a honeycomb pattern.

7. The glove of claim 1, wherein the pods and the connecting tabs are continuous with one another and formed as a one-piece construction.

8. The glove of claim 7, wherein the material layer is injection molded.

* * * * *